US009206579B2

(12) United States Patent
Dornberg

(10) Patent No.: US 9,206,579 B2
(45) Date of Patent: Dec. 8, 2015

(54) APPARATUS FOR FORMING A PROTECTED REGION IN A BODY OF WATER AND METHOD FOR ASSEMBLING AN APPARATUS

(76) Inventor: Gerd Dornberg, Dietzenbach (DE)

( * ) Notice: Subject to any disclaimer, the term of this patent is extended or adjusted under 35 U.S.C. 154(b) by 0 days.

(21) Appl. No.: 12/796,758

(22) Filed: Jun. 9, 2010

(65) Prior Publication Data

US 2011/0299935 A1 Dec. 8, 2011

(30) Foreign Application Priority Data

Jun. 2, 2010 (DE) ..... 10 2010 017 220

(51) Int. Cl.
*E02D 19/02* (2006.01)
*B65D 88/00* (2006.01)
*E21B 43/01* (2006.01)

(52) U.S. Cl.
CPC ..... *E02D 19/02* (2013.01); *E21B 43/0122* (2013.01)

(58) Field of Classification Search
USPC ..... 405/60, 110–112, 203; 414/13
See application file for complete search history.

(56) References Cited

U.S. PATENT DOCUMENTS 4,059,065 A 11/1977 Clark et al.
5,088,858 A * 2/1992 Massoudi ..... 405/203
6,012,873 A 1/2000 Copple et al.
6,022,172 A * 2/2000 Siyaj ..... 405/110
6,164,870 A * 12/2000 Baruh ..... 405/114
6,672,803 B2 * 1/2004 Richter et al. ..... 405/195.1
2001/0036387 A1 11/2001 Richter et al.
2003/0165361 A1 9/2003 Richter et al.
2007/0116522 A1 * 5/2007 Boudreaux, Jr. ..... 405/114
2007/0154265 A1 * 7/2007 Stauffacher et al. ..... 405/110
2008/0134589 A1 * 6/2008 Abrams et al. ..... 52/79.1
2008/0203093 A1 * 8/2008 Skulnick ..... 220/239
2011/0016802 A1 * 1/2011 Wallance ..... 52/79.9

FOREIGN PATENT DOCUMENTS

EP 0 128 976 12/1984
EP 0128976 A1 * 12/1984
NL 8304045 A 6/1985

OTHER PUBLICATIONS

International Search Report; PCT/DE2011/075128; Int'l File Date: Jun. 1, 2011; Gerd Dornberg; 2 pages.

* cited by examiner

*Primary Examiner* — John Kreck
*Assistant Examiner* — Kyle Armstrong
(74) *Attorney, Agent, or Firm* — Schmeiser, Olsen & Watts, LLP

(57) ABSTRACT

The invention relates to an apparatus (1) for forming a protected region in a body of water with a wall (2) and an internal region (4) delimited from the body of water by means of the wall (2), wherein the wall (2) is formed from a plurality of hollow bodies (3) which are connected to one another and arranged in a stacked structure. Furthermore, the invention relates to a method for assembling an apparatus (1) for forming a protected region in a body of water.

12 Claims, 12 Drawing Sheets

APPARATUS FOR FORMING A PROTECTED REGION IN A BODY OF WATER AND METHOD FOR ASSEMBLING AN APPARATUS

The invention relates to an apparatus for forming a protected region in a body of water and a method for assembling an apparatus of this type.

BACKGROUND

Working in a body of water and also transporting objects or fluids in a body of water constitutes a great technological challenge. Particularly the confinement and transporting of oil, which escapes from an oil source at the bottom of a body of water, is difficult on account of the pressure prevailing in the depths of the body of water and the currents arising there.

SUMMARY

An aspect relates to an apparatus for forming a protected region in a body of water and a method for assembling the apparatus, which enable a flexible deployment adapted to the use and wherein the assembling of the apparatus is simplified.

One aspect of the invention comprises the idea of an apparatus for forming a protected region in a body of water with a wall and an internal region delimited from the body of water by means of the wall, wherein the wall is formed from a plurality of hollow bodies which are connected to one another and arranged in a stacked structure.

According to a further aspect of the invention, the idea of a method for assembling an apparatus for forming a protected region in a body of water with a wall and an internal region delimited from the body of water by means of the wall is embodied, wherein the method comprises the following steps:

providing a plurality of hollow bodies and connecting the plurality of hollow bodies for forming the wall, wherein the hollow bodies are arranged in a stacked structure An apparatus for forming a protected region with a wall, which is formed from a plurality of hollow bodies which are connected to one another and arranged in a stacked structure, can be adapted to the respective conditions in the body of water, such as for example water depth and current speed, by means of the selection of suitable hollow bodies. The stacked structure of the hollow bodies is realized by means of a plurality of plies of hollow bodies arranged one above the other, wherein each ply comprises a plurality of hollow bodies. The cross section and the stability of the apparatus are determined by means of the type, number and arrangement of the hollow bodies in a ply of the stack. A great flexibility is ensured as a result.

Furthermore, the assembling of the apparatus for forming a protected region in a body of water is simplified. The hollow bodies can be transported to a selected position in the body of water and there be assembled in situ. By means of the stacked structure, the hollow bodies are arranged in a plurality of plies which lie one above the other. For the assembling of the apparatus, a first ply made of hollow bodies is formed on the body of water in that the hollow bodies are connected to one another. The first ply floats on the surface of the body of water. Subsequently, a second ply of hollow bodies is arranged on the first ply. The hollow bodies of the second ply are connected to one another and to the hollow bodies of the first ply. Further plies of hollow bodies are subsequently assembled and connected on the respective ply located therebeneath.

Possible applications for the apparatus for forming a protected region in a body of water are manifold. A fluid line can be formed in a body of water by means of the apparatus, for example. To this end, the apparatus is arranged over an oil source located on a bottom of a body of water. The oil leaving the oil source flows in the internal region to the surface of the body of water, where it is pumped away. Supplementarily or alternatively, solid objects can be transported from the surface of the body of water to the bottom of the body of water and/or in the other direction in a controlled manner within the internal region of the apparatus. Both during the transporting of fluids and the transporting of objects, the wall of the apparatus prevents these from being directly subjected to the influences of the body of water. A drifting off of the transported fluids/objects in the body of water is prevented by means of the wall. Furthermore, the internal region of the apparatus forms a protected region in which operations, for example excavations, can be carried out at the bottom of the body of water. Finally, the device can be used for protecting conventional lines for fluids in a body of water. To this end, the device is assembled in such a manner that the conventional line is arranged in the internal region. If a defect arises on the conventional line and fluid escapes from the conventional line, it makes it into the internal region of the apparatus. Within the internal region, the fluid floats to the surface of the body of water and can be pumped away there. A drifting off of the escaping fluid into the body of water is thereby avoided and safety increases.

Preferably, a configuration of the invention provides that the hollow bodies are arranged offset with respect to one another in the stacked structure. The stability of the wall is thereby increased. A stacked structure of the wall, in which the hollow bodies of adjacent plies are arranged offset with respect to one another, is similar to masonry made from bricks. Supplementarily or alternatively, it may be provided that the wall is surrounded at least in sections with a reinforcement element. The reinforcement element is here formed from a material with a larger tensile and/or tear strength than the material from which the hollow bodies are formed. For example, the reinforcement element is a steel cable.

In a purposeful configuration of the invention, it may be provided that the hollow bodies are releasably connected to one another. As a result, a reuse of the apparatus is simplified. A releasable connection has the advantage that the device can be disassembled again following successful use and the hollow bodies can be transported away individually. Subsequently, the hollow bodies can be used for a new apparatus at another location or also for other purposes. The hollow bodies can for example be connected to one another by means of a screwed connection. Alternatively, the hollow bodies can be connected to one another by means of a riveted connection and/or a welded connection. Furthermore, it can alternatively or supplementarily be provided that the hollow bodies are formed with projections and receptacles assigned to one another, by means of which the hollow bodies are connected. The projections are for example formed as hooks and the receptacles are for example formed as eyelets.

A preferred development of the invention provides that at least a portion of the hollow bodies is formed with openings, by means of which the portion of the hollow bodies is flooded with water. The portion of the hollow bodies which is formed with openings and is flooded with water brings about a sinking of the apparatus in the body of water. Another portion of the hollow bodies which is not flooded with water brings about a lift. The flooding of at least one portion of the hollow bodies therefore makes it possible to set the position of the apparatus in the body of water. A balanced ratio of flooded and non-flooded hollow bodies stabilizes the position of the apparatus in the body of water. Supplementarily or alternatively, it may be provided that the openings are sealable. Furthermore, it can alternatively be provided that all hollow bodies are formed with openings and are flooded with water.

In an advantageous configuration of the invention, it can be provided that the hollow bodies are 40 foot containers standardized in accordance with ISO 668. 40 foot containers are available in large numbers and very stable and can be stacked one above the other in a simple manner. Alternatively or supplementarily, it can be provided that the hollow bodies are 20 foot containers and/or 45 foot containers (so-called "high cube" containers). It may be provided that the wall is assembled from various types of the previously mentioned containers. Alternatively, it may be provided to further adapt the 40 foot containers, the 20 foot containers and/or the 45 foot containers for use in the apparatus. A preferred development of the invention provides to remove the side walls of the containers and replace them with bamboo stems. As a result, a weight reduction of the containers is achieved with a still high stability. For containers which are flooded permanently, it may be provided to remove the bottom and the lid of these containers without this leading to a reduction of the inherent stability. Furthermore, it may alternatively be provided that hollow bodies of another construction, which is adapted to the conditions in the body of water, are used. It may preferably be provided to form the hollow bodies with simple geometric figures, for example cuboidal or in the shape of a circular arc. A rectangular or square cross section can be assembled in a simple manner with cuboidal hollow bodies. Likewise, other polygonal or even circular cross sections can be realized with cuboidal hollow bodies. Preferably, the hollow bodies are formed from a material from the following group of materials: metals, metallic alloys, particularly steel and plastics, preferably recyclable plastics. It may alternatively be provided that the hollow bodies are formed with a steel primary construction and an infill of the walls made from bamboo, wood and/or similar materials.

A preferred development of the invention provides that the wall is connected to a bottom of a body of water by means of an anchoring device. This increases the stability of the apparatus and prevents a drifting away from the selected location. The anchoring device can for example be formed with at least one chain which is fixed at one end to the wall and anchored at the other end to the bottom of the body of water. Alternatively or supplementarily, it may be provided that the wall in one region close to the surface of the body of water is connected to a ship by means of at least one connection element. As a result, the wall is stabilized and a drifting away during the assembly is prevented. The connection element can be formed as a rope, a steel cable or a chain. Alternatively or supplementarily, further stabilizations are provided by means of the connection of the wall to certain positions, for example to at least one submarine, by means of high-tensile cables. The wall of the apparatus preferably extends beyond the length from the bottom of the body of water to the surface of the body of water. A lower end of the wall of the apparatus, which is preferably used as a fluid line, can for example be arranged over an oil source on the bottom of the body of water. The oil escapes from the oil source and makes it through the internal region of the apparatus, which is delimited from the surrounding body of water, to the surface of the body of water. If an upper portion of the wall extends beyond the surface of the body of water, a spring-like region, which is likewise delimited from the body of water, is formed at the surface of the body of water. The risen oil collects in this region and can be pumped away from here. Supplementarily to this, water which is likewise located in the delimited region at the surface of the body of water can be pumped away. By means of pumping away the water from the internal region of the apparatus, the creation of a reduced pressure with respect to the conditions outside of the apparatus is achieved, as a result of which the oil rising from the depths makes it to the surface more easily and faster.

A development of the invention can provide that at least one stabilization device is arranged at a side of the wall which faces the body of water. The at least one stabilization device increases the stability of the wall and allows the position and shape of the apparatus to be adapted in the water. The stabilization device can for example be formed as a drive element with a motor and a propeller driven by the motor. Position corrections can be carried out with this, in order for example to react to the influence of a current. Preferably, a plurality of stabilization devices can be arranged in a plurality of regions of the wall at different depths of the body of water. It can more preferably be provided that the at least one stabilization device is formed with a receiver device for a satellite navigation system (GPS—Global Positioning System). As a result, a determination of position data is enabled for the stabilization device. More preferably, the at least one stabilization device is formed with a transmission device, which is coupled to the receiving device and trans-mits the position data to a monitoring station.

Different forces are to be taken into account at different depths in the body of water, depending on the vertical extent (length or depth) of the apparatus, which forces act horizontally on the wall of the apparatus, for example currents. The apparatus can deform in a certain predetermined order of magnitude, based on the ideal straight line. An "overdeforming" and possible "tearing" of the construction connected therewith is prevented by means of the use of the, for example GPS-controlled, stabilizers.

In an advantageous configuration of the invention, it can be provided that at least one illumination device and/or a camera and/or a measurement device is arranged on the side of the wall facing the internal region. A monitoring of the internal region takes place with the at least one illumination device and/or the camera and/or the measurement device.

BRIEF DESCRIPTION OF THE DRAWINGS

The invention is explained in more detail in the following on the basis of preferred exemplary embodiments with reference to figures of a drawing. In the figures.

DETAILED DESCRIPTION

In the following, identical reference numbers are used for identical elements.

Figure 1B:
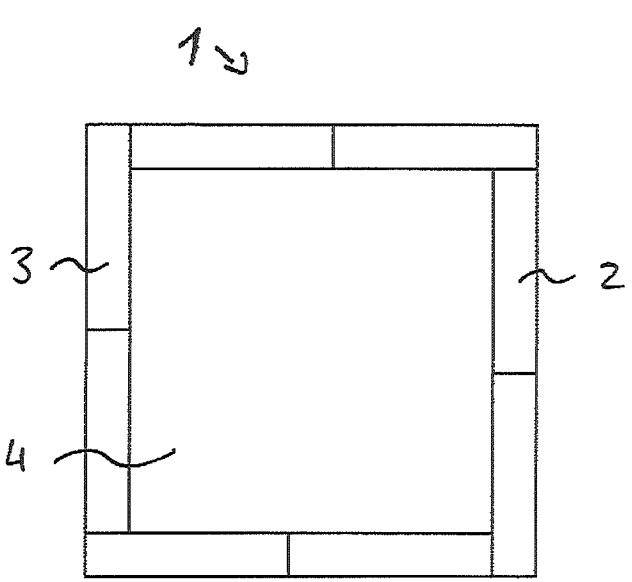
FIG. 1*b* shows a schematic plan view onto a cross section of the apparatus.
Figure 1A:
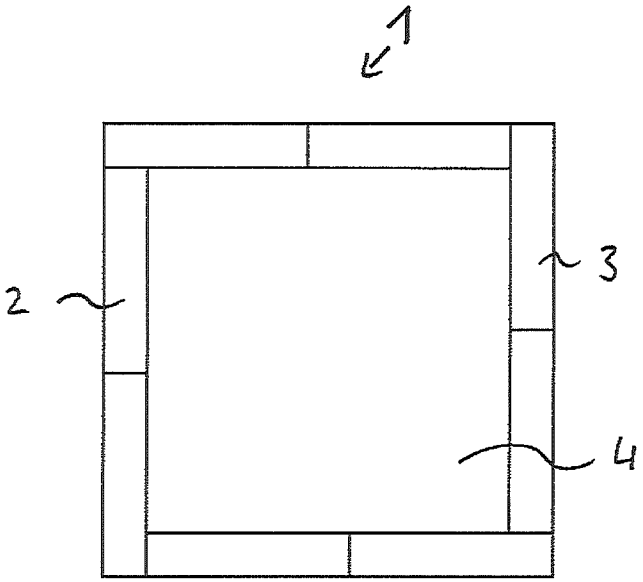
FIG. 1*a* shows a schematic plan view onto a cross section of an apparatus.

FIGS. 1*a* and 1*b* in each case show a schematic plan view onto a cross section of the apparatus 1. The wall 2 of the apparatus 1 is formed from a plurality of plies stacked one above another made of a plurality of hollow bodies 3. The hollow bodies 3 of a ply are here releasably connected, for example screwed, to one another. In the embodiment shown, a ply is formed which is made from eight cuboidal hollow bodies 3, which are arranged in such a manner that the apparatus 1 has a square cross section which surrounds an internal region 4. For assembling the wall 2, the plies shown in FIGS. 1*a* and 1*b* are arranged alternatingly one above the other and releasably connected, for example screwed, to one another. The hollow bodies 3 of adjacent plies are therefore arranged in a manner offset with respect to one another, as a result of which the stability of the wall 2 is increased.

Figure 2:
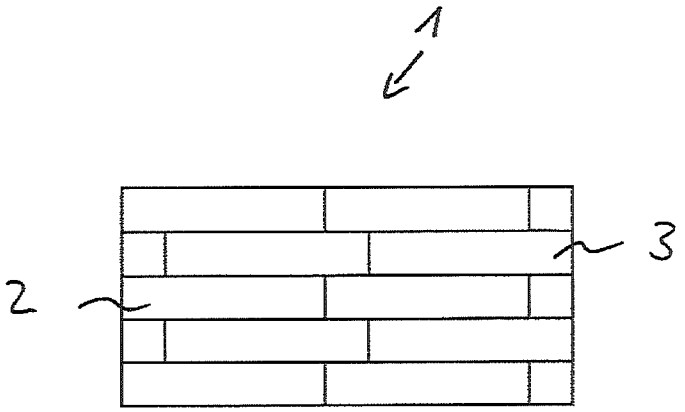
FIG. 2 shows a schematic side view of the apparatus.

FIG. 2 shows a schematic side view of the apparatus 1. The wall 2 is formed with a plurality of hollow bodies 3 which are arranged in a stacked structure with the plies shown in FIGS. 1*a* and 1*b*. The hollow bodies 3 of adjacent plies are arranged in a manner offset with respect to one another and releasably connected to one another.

Figure 3:
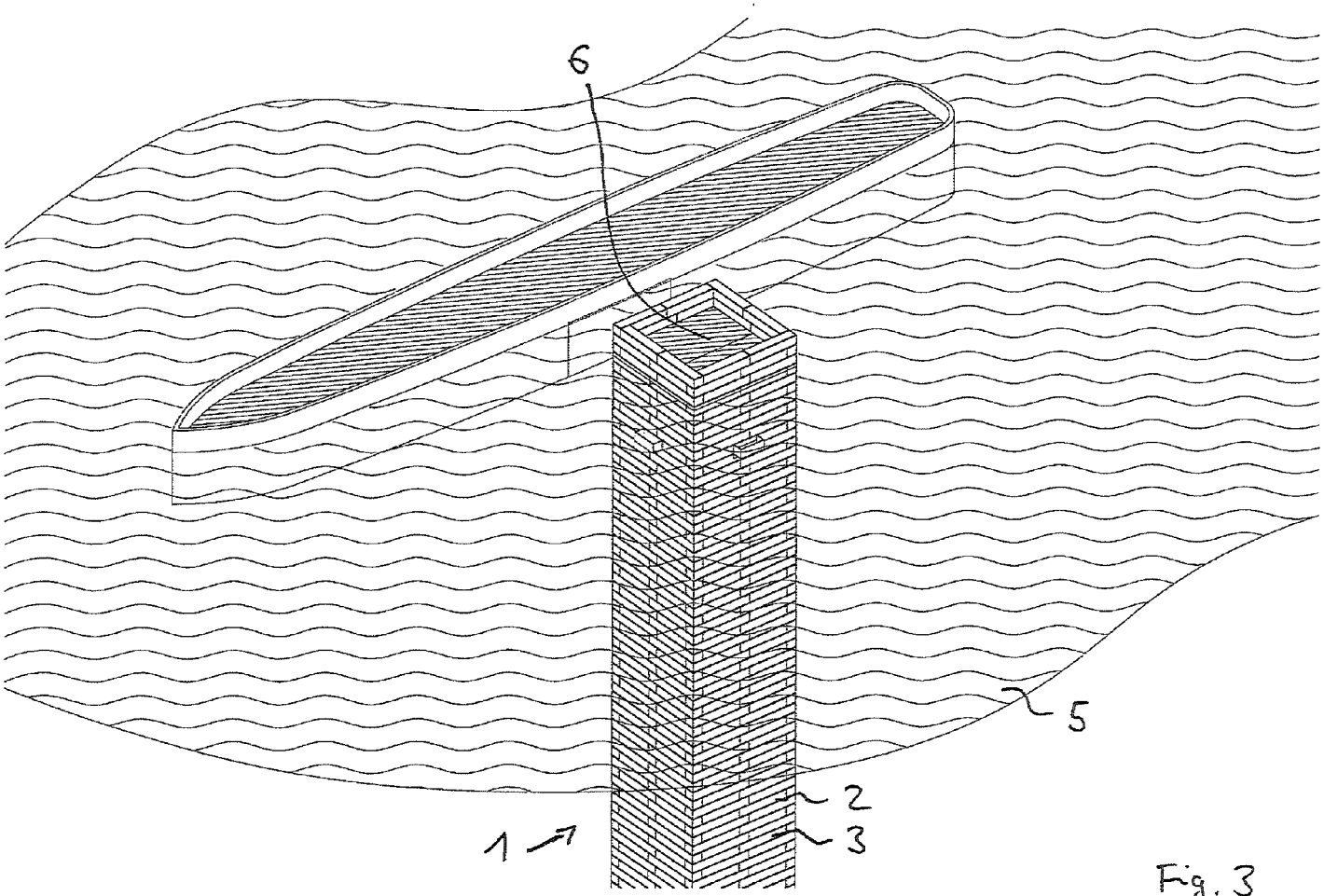
FIG. 3 shows a perspective illustration of the apparatus

FIG. 3 shows a perspective illustration of the apparatus 1 for the use as a fluid line. The stacked structure of the wall 2 is realized with the arrangement of hollow bodies 3 shown in FIGS. 1*a* and 1*b*. At an upper end of the apparatus 1, the wall 2 extends beyond the surface 5 of the body of water. A region 6 which is delimited from the body of water and the surface 5 of the body of water is formed.

Figure 4C:
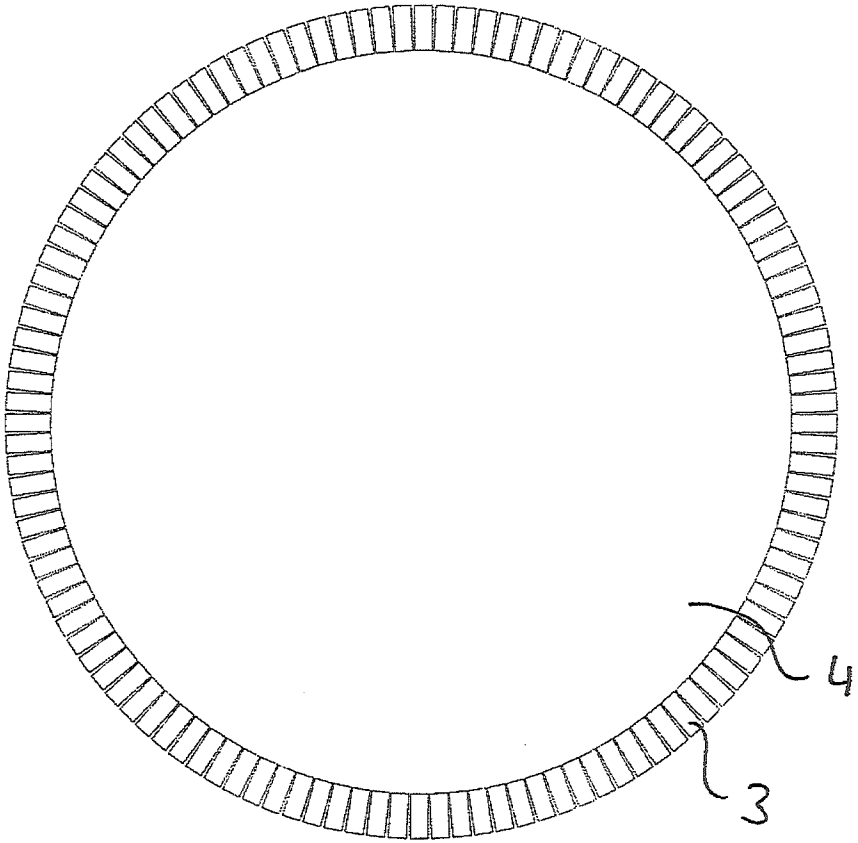
FIG. 4*c* shows a schematic plan view onto an alternative cross section of the apparatus.
Figure 4B:
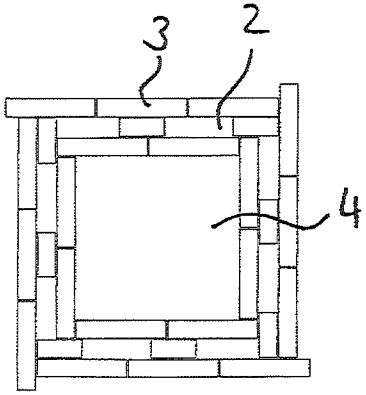
FIG. 4*b* shows a schematic plan view onto an alternative cross section of the apparatus.
Figure 4A:
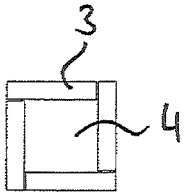
FIG. 4*a* shows a schematic plan view onto an alternative cross section of the apparatus.

FIGS. 4*a*, 4*b* and 4*c* in each case show a schematic plan view onto a cross section of the apparatus 1 in alternative embodiments. Various shapes and sizes of the internal region 4 are realized as a result. In FIG. 4*b* it is shown that the wall 2 is formed with two layers of hollow bodies 3 arranged around one another in a ply. Between the two layers of hollow bodies 3, further possibly shorter hollow bodies, for example 20 foot containers, are inserted as constructive spacers. As a result, the flexibility of the wall is reduced compared to an embodiment shown in FIGS. 1*a* and 1*b*, yet the stability of the wall 2 is increased once more. A development of the apparatus with a circular cross section is shown in FIG. 4*c*. To this end, 20 foot containers can for example be used for the hollow bodies 3. Alternatively, another number and/or another arrangement of hollow bodies in a ply can be selected. Likewise, alternatively or supplementarily, hollow bodies can be used with other geometric shapes, for example in the shape of a circular arc, in order to realize a desired cross section of the apparatus.

Figure 5:
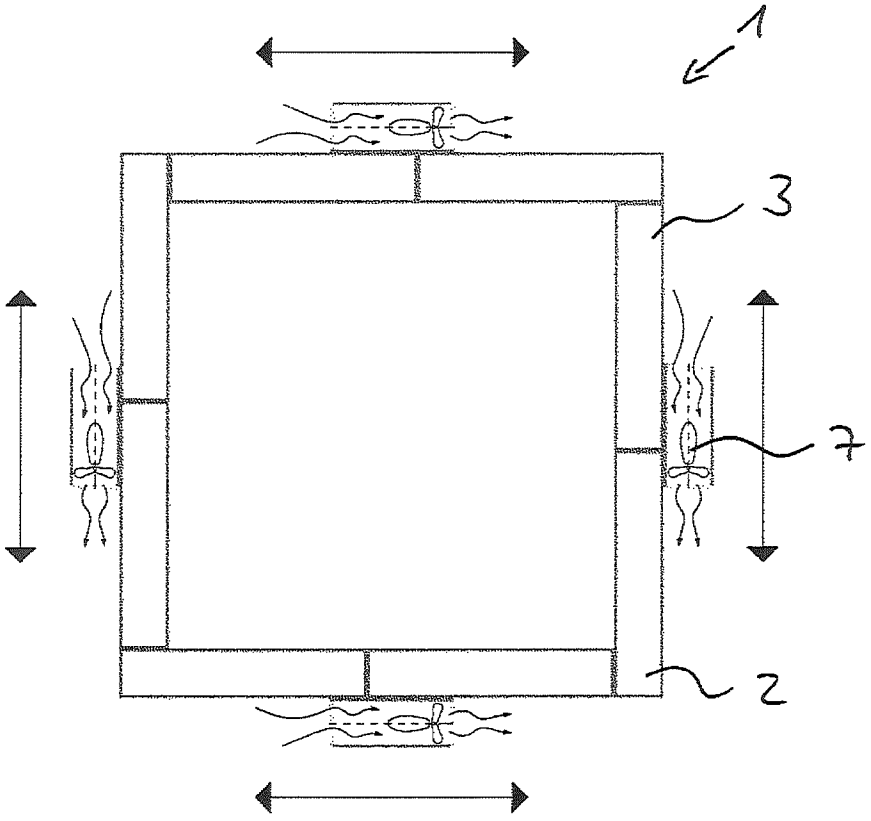
FIG. 5 shows a schematic plan view onto a cross section of the apparatus with at least one stabilization device.

FIG. 5 shows a schematic plan view onto a cross section of the apparatus 1 with four stabilization devices 7. A stabilization device 7 is arranged at each side of the wall 2 which faces the body of water in each case. The stabilization device 7 is formed with a motor and a propeller driven by the motor. As a result, position corrections of the relevant length section of the apparatus and/or the apparatus 1 as a whole are enabled. The stabilization device 7 is arranged in a container which is open at the front and the rear.

Figure 6:
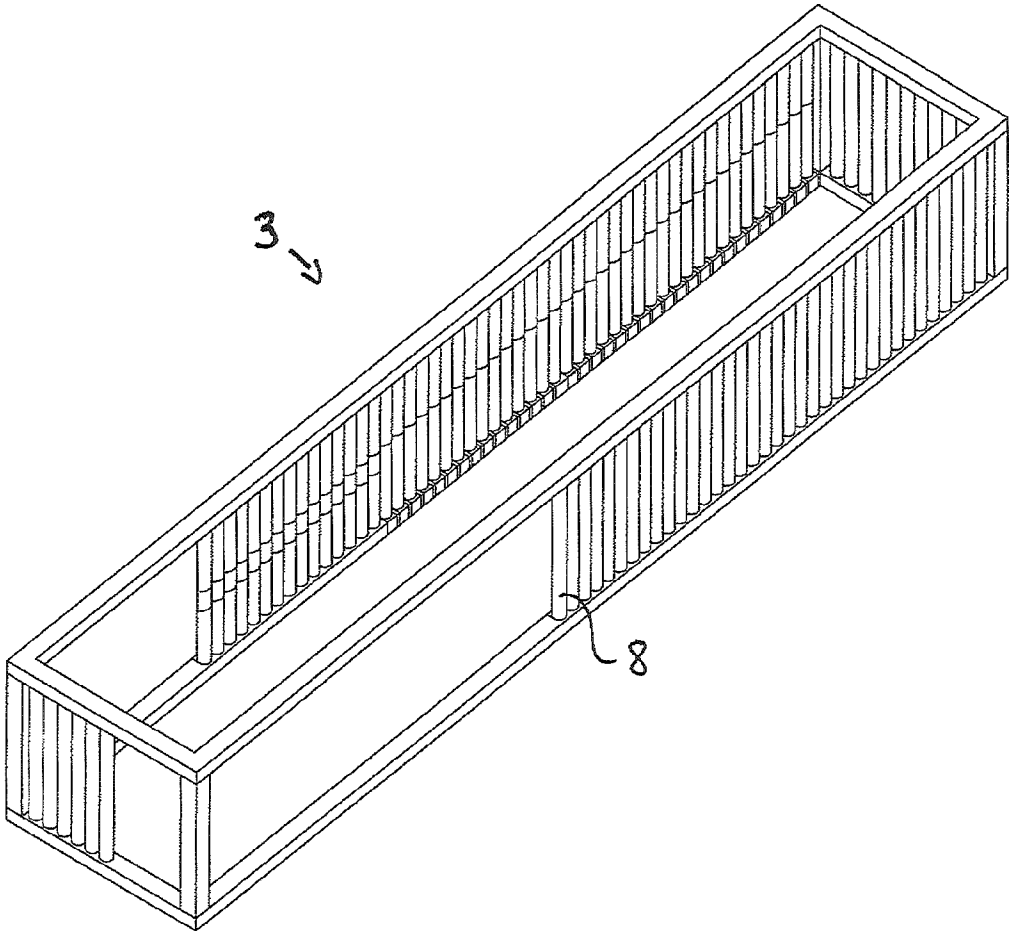
FIG. 6 shows a perspective illustration of a hollow body.

FIG. 6 shows a perspective illustration of a hollow body 3. The hollow body 3 is a 40 foot container standardized in accordance with DIN 668. In the case of containers which are permanently flooded, the bottom and top plates of the container can be removed, however only in such a manner that the inherent stability of the container is not reduced. The containers are generally made from steel. In the embodiment shown, the 40 foot container is adapted for use in the apparatus 1. The side walls of the container made from steel are removed and replaced with bamboo canes 8. As a result, a weight reduction is achieved with essentially the same stability.

Figure 7:
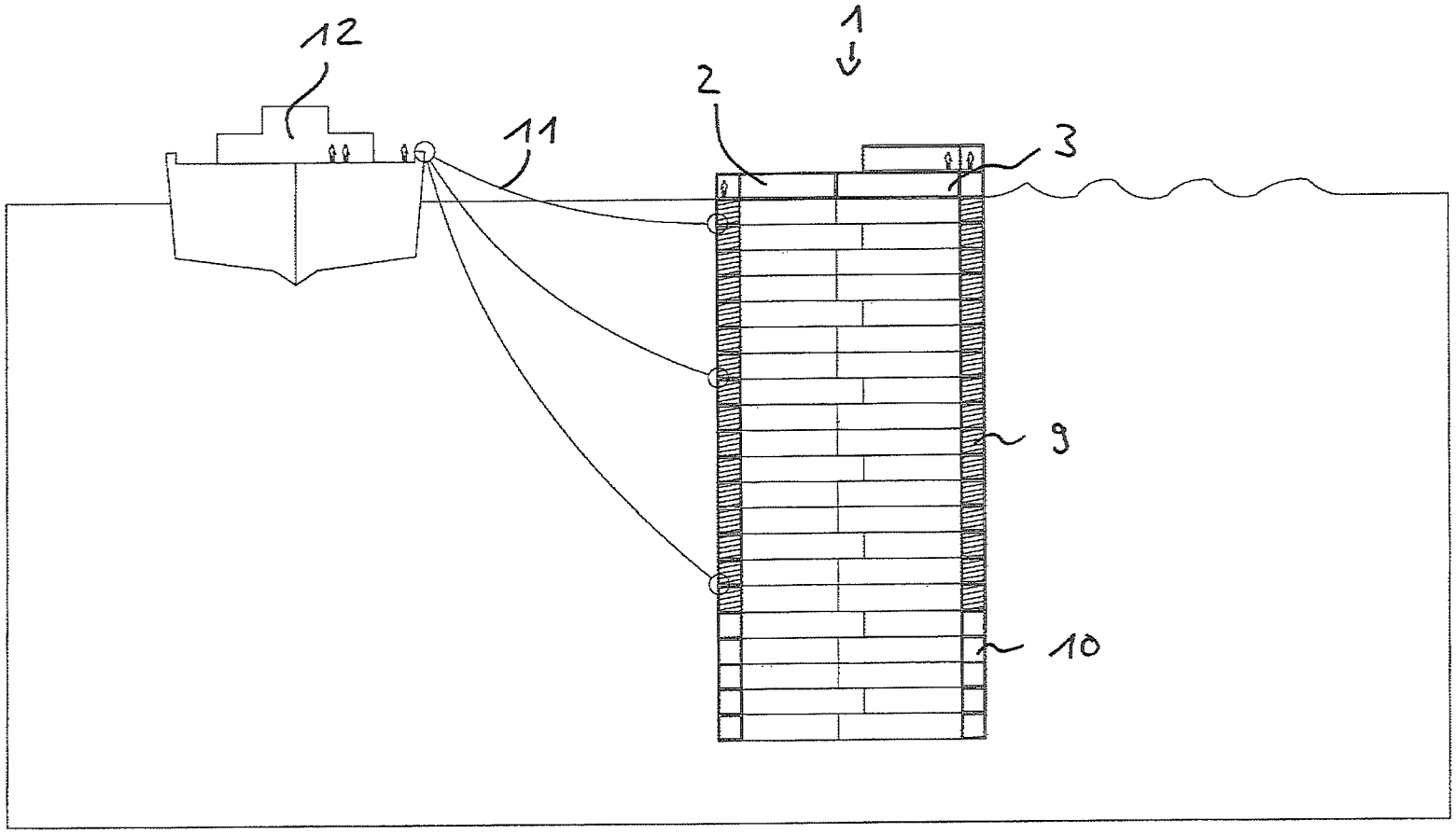
FIG. 7 shows a schematic illustration of the structure of the apparatus.

In the following, the assembly of the apparatus 1 in a body of water is described with reference to FIG. 7. The hollow bodies 3, for example 40 foot containers, are transported to a selected position on the surface of the body of water. A few hollow bodies are arranged in a floating manner on the water surface at a first position to form a first play and are releasably connected to one another. The arrangement of the hollow bodies 3 here determines the cross section of the apparatus 1. It corresponds to the arrangement shown in FIG. 1*a* in the embodiment shown here.

Hollow bodies 3 of a second ply are arranged on the hollow bodies 3 of the first ply. The hollow bodies 3 of the second ply are releasably interconnected with one another and with the hollow bodies 3 of the first ply. The hollow bodies 3 of the second ply are here arranged offset with respect to the hollow bodies 3 of the first ply, as is shown in FIG. 2.

At least one portion or alternatively all hollow bodies 3 of the first ply are flooded with water by means of openings. As a result, the apparatus 1 sinks in the body of water. The hollow bodies of the second ply here remain above the surface of the body of water. Further plies of hollow bodies 3 are one after the other arranged on the respective ply located therebeneath and connected to one another. At least one portion of the hollow bodies 3 is here formed with openings, by means of which the portion of the hollow bodies 3 is flooded with water. As a result, the apparatus 1 is balanced in the body of water in such a manner that an upper end of the wall 2 always projects beyond the surface of the body of water. FIG. 7 by way of example shows a portion of the hollow bodies 9 flooded with water and a portion of hollow bodies 10 not flooded with water. The hollow bodies 10 not flooded with water are formed in an airtight manner. In the case of a use at large depths, constructive pressure equalization measures for the walls of the hollow bodies 10 are alternatively or supplementarily to be provided in the interior of the hollow bodies 10 not flooded with water, for example by means of commercially available shoring struts.

During the assembly and alternatively also subsequently, the wall 2 is connected in an upper region with at least one connection element 11 to a ship 12. The connection element 11 is for example a steel cable. As a result, the position of the apparatus 1 in the body of water is stabilized.

Figure 8:
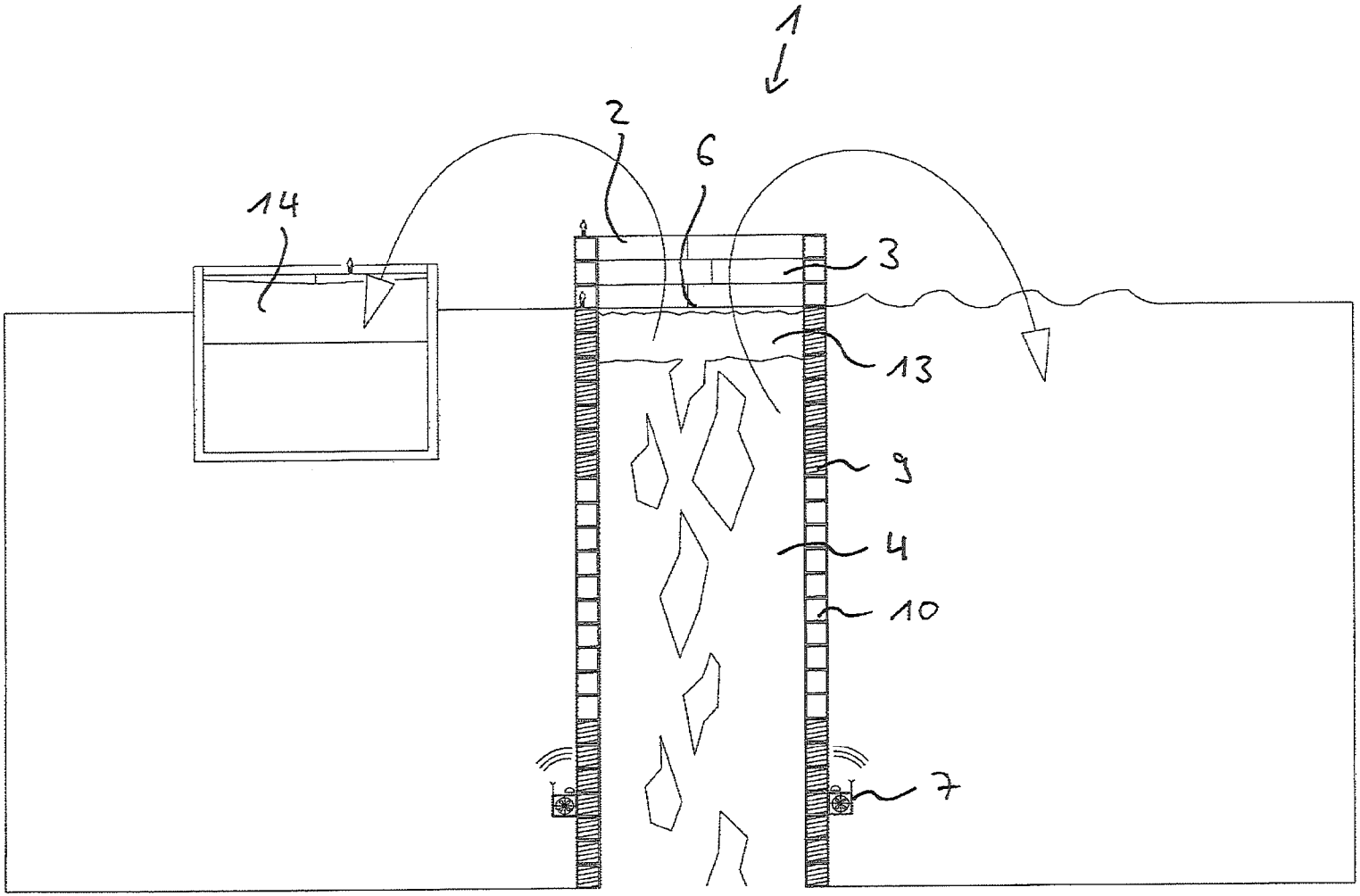
FIG. 8 shows a schematic illustration of the operation of the apparatus as a fluid line.

It is shown in FIG. 8 how oil 13 rises from an oil source at the bottom of the body of water in the internal region 4 of the apparatus 1 to the surface of the body of water and collects in a delimited region 6. Here, the apparatus 1 is used as a fluid line. The oil 13 is pumped away from the region 6 into a tanker 14. Water is likewise pumped away from the region 6 and conveyed into the body of water. Stabilization devices 7 are arranged at the side of the wall 2 facing the body of water. The stabilization devices 7 are formed with a receiver for a satellite navigation system and a transmitter coupled to the receiver. The position data determined by the receiver are transmitted by means of the transmitter to a monitoring station.

Figure 9C:
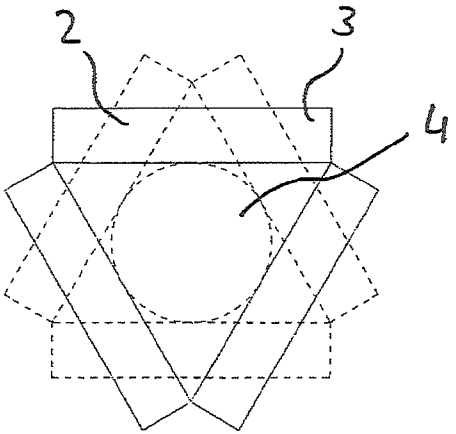
FIG. 9*c* shows a schematic plan view onto an alternative cross section of the apparatus.
Figure 9B:
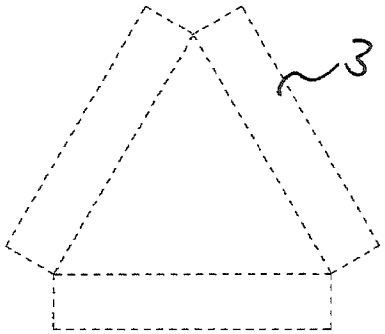
FIG. 9*b* shows a schematic plan view onto an alternative cross section of the apparatus.
Figure 9A:
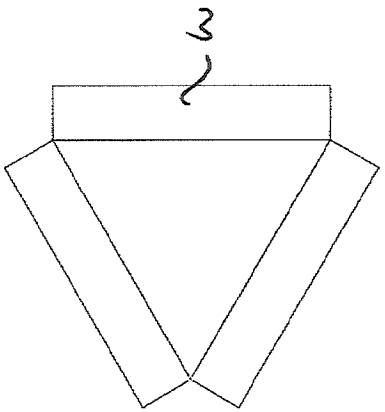
FIG. 9*a* shows a schematic plan view onto an alternative cross section of the apparatus.

FIGS. 9*a*, 9*b* and 9*c* show a schematic plan view onto an alternative cross section of the apparatus. FIG. 9*a* shows an arrangement of the hollow bodies 3 which form the odd plies of the stacked structure. An arrangement of the hollow bodies 3 which form the even plies of the stacked structure is shown in FIG. 9*b*. FIG. 9*c* shows the offset arrangement of the plies from FIGS. 9*a* and 9*b* for constructing the wall 2 which surrounds the internal region 4.

Figure 10:
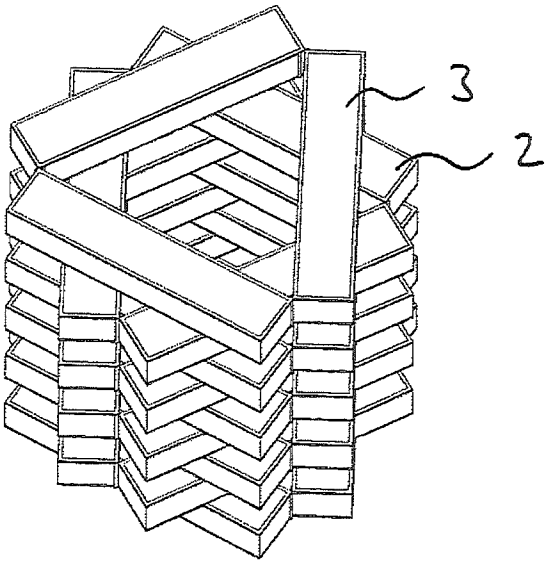
FIG. 10 shows a perspective illustration of the apparatus with the arrangement of the hollow bodies from the FIGS. 9*a*, 9*b* and 9*c*.

FIG. 10 shows a perspective illustration of the device with the arrangement of the hollow bodies from the FIGS. 9*a*, 9*b* and 9*c*. As a result, a very stable wall 2 is created with little use of material.

Figure 11C:
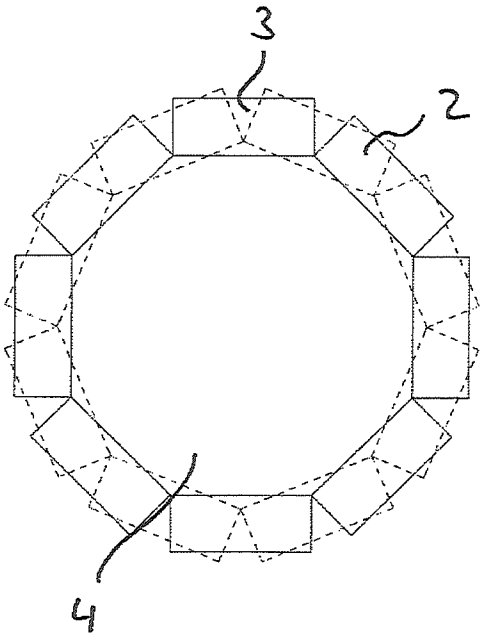
FIG. 11*c* shows a schematic plan view onto an alternative cross section of the apparatus and FIG. 12 shows a perspective illustration of the apparatus with the arrangement of the hollow bodies from the FIGS. 11*a*, 11*b* and 11*c*.
Figure 11B:
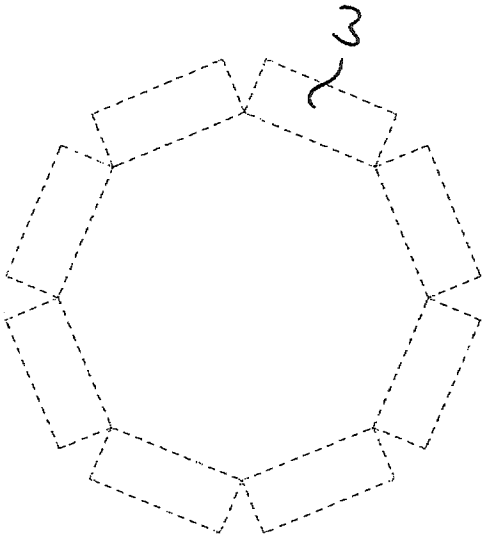
FIG. 11*b* shows a schematic plan view onto an alternative cross section of the apparatus.
Figure 11A:
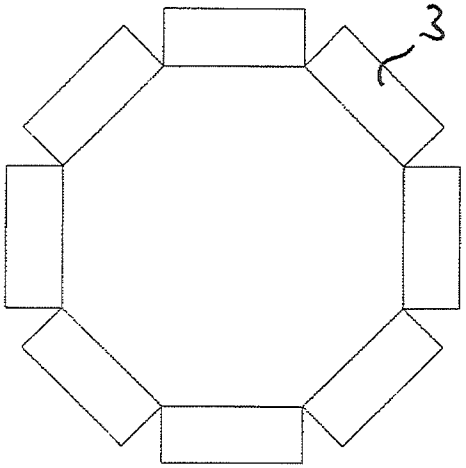
FIG. 11*a* shows a schematic plan view onto an alternative cross section of the apparatus.

FIGS. 11*a*, 11*b* and 11*c* show a schematic plan view onto an alternative cross section of the apparatus. FIG. 11*a* shows the odd plies of the stacked structure of an arrangement of the hollow bodies 3. FIG. 11*b* shows an arrangement of the hollow bodies 3 which form the even plies of the stacked structure. The offset arrangement of the plies from the FIGS. 11*a* and 11*b* for constructing the wall 2 which surrounds the internal region 4 is shown in FIG. 11*c*.

Figure 12:
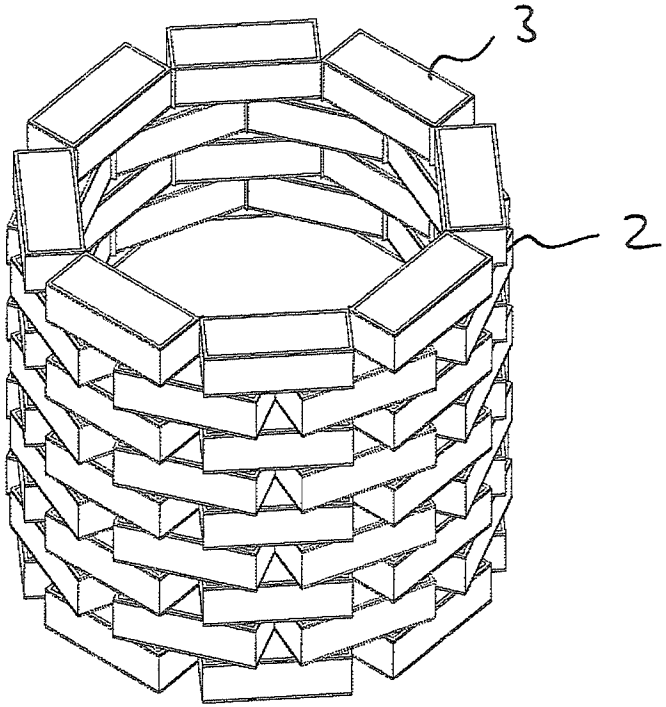

FIG. 12 shows a perspective illustration of the apparatus with the arrangement of the hollow bodies from the FIGS. 11*a*, 11*b* and 11*c*. An essentially circular cross section of the wall 2 is formed as a result.

The features of the invention disclosed in the previous description, the claims and the drawing can be of significance both individually and in any desired combination for the realization of the invention in its various configurations.

The invention claimed is:

1. An apparatus for forming a protected region in a body of water, comprising:

a wall; and an internal region surrounded by the wall to form a delimited region that is delimited from the body of water such that the wall separates water, of the body of water, that is located inside the delimited region from water, of the same body of water, outside the delimited region, the delimited region configured to receive water and at least one substance;

wherein the wall is formed from a plurality of plies which are connected to one another and arranged in a stacked structure, the stacked structure formed by the plurality of plies being arranged one above another, wherein each ply of the plurality of plies comprises a plurality of hollow bodies;

wherein the plurality of hollow bodies are formed from at least one of a metal and a metallic alloy;

wherein the plurality of hollow bodies are at least one of: a 20 foot container, a 40 foot container, and a 45 foot container, in accordance with International Standard ISO 668;

wherein the wall is surrounded at least in sections with a steel-cable reinforcement element.

2. The apparatus according to claim 1, wherein the plurality of hollow bodies are arranged offset with respect to one another in the stacked structure.

3. The apparatus according to claim 1, wherein the plurality of hollow bodies are releasably connected to one another.

4. The apparatus according to claim 1, wherein at least a portion of the plurality of hollow bodies is formed with openings, by means of which the portion of the hollow bodies is flooded with water.

5. The apparatus according to claim 1, wherein the wall is connected to a bottom of a body of water by means of an anchoring device.

6. The apparatus according claim 1, wherein at least one stabilization device is arranged at a side of the wall which faces the body of water.

7. The apparatus of claim 6, wherein the at least one stabilization device is formed with a receiver for a satellite navigation system, the receiver being coupled to a transmitter, further wherein a position data determined by the receiver is transmitted by the transmitter to a monitoring station.

8. The apparatus for forming a protected region in a body of water of claim 1, wherein the reinforcement element is formed from a material with a larger tensile and/or tear strength than a material from which the plurality of hollow bodies are formed.

9. The apparatus of claim 1, wherein a portion of the stacked structure is submerged in the body of water.

10. An apparatus for forming a protected region in a body of water, comprising:

a plurality of hollow bodies connected to one another and arranged in a stacked structure, the stacked structure formed by the plurality of hollow bodies being arranged one above another, to form an enclosed, delimited region in the body of water, wherein the stacked structure is surrounded by water from the body of water;

wherein the enclosed, delimited region in the body of water includes water, from the body of water, that contacts an inner surface of the stacked structure, and wherein water, from the body of water, outside the delimited region contacts an outer surface of the stacked structure;

wherein the enclosed, delimited region of water from the body of water is configured to receive at least one substance, and prevents an uncontrolled distribution of the at least one substance;

wherein the plurality of hollow bodies are at least one of: a 20 foot container, a 40 foot container, and a 45 foot container, in accordance with International Standard ISO 668;

wherein the wall is surrounded at least in sections with a steel-cable reinforcement element.

11. The apparatus of claim 10, wherein the at least one substance is oil that is from an oil source at a bottom of the body of water and rises to a surface of the body of water within the enclosed, delimited region.

12. The apparatus of claim 10, wherein a portion of the stacked structure is submerged in the body of water.

* * * * *